US012139988B2

(12) United States Patent
Evans

(10) Patent No.: US 12,139,988 B2
(45) Date of Patent: Nov. 12, 2024

(54) RELEASE LUGS FOR A JARRING DEVICE

(71) Applicant: Robert W. Evans, Montgomery, TX (US)

(72) Inventor: Robert W. Evans, Montgomery, TX (US)

( * ) Notice: Subject to any disclaimer, the term of this patent is extended or adjusted under 35 U.S.C. 154(b) by 0 days.

(21) Appl. No.: 18/516,535

(22) Filed: Nov. 21, 2023

(65) Prior Publication Data

US 2024/0093562 A1 Mar. 21, 2024

Related U.S. Application Data

(63) Continuation of application No. 17/968,756, filed on Oct. 18, 2022, now Pat. No. 11,821,278, which is a continuation of application No. 17/461,395, filed on Aug. 30, 2021, now Pat. No. 11,473,385, which is a continuation of application No. 16/534,778, filed on Aug. 7, 2019, now Pat. No. 11,105,169, which is a continuation of application No. 15/973,247, filed on May 7, 2018, now Pat. No. 10,408,009, which is a continuation-in-part of application No. 14/621,577, filed on Feb. 13, 2015, now Pat. No. 10,202,815.

(51) Int. Cl.
*E21B 31/107* (2006.01)
*E21B 23/00* (2006.01)

(52) U.S. Cl.
CPC ..... *E21B 31/107* (2013.01); *E21B 23/00* (2013.01)

(58) Field of Classification Search
CPC ..... E21B 31/113; E21B 31/1135; E21B 31/1075; E21B 31/107
See application file for complete search history.

(56) References Cited

U.S. PATENT DOCUMENTS

| | | | | |
|---|---|---|---|---|
| 1,020,815 A | | 3/1912 | Fielding, Jr. | |
| 2,065,135 A | | 3/1927 | Sumter et al. | |
| 2,008,743 A | * | 7/1935 | Black | E21B 31/107 175/304 |
| 2,029,579 A | * | 2/1936 | McCullough | E21B 31/107 175/303 |
| 2,047,209 A | | 7/1936 | Lawlor | |
| 2,144,810 A | | 1/1939 | Raymond | |
| 2,618,466 A | | 11/1952 | Bagnell et al. | |
| 2,618,467 A | | 11/1952 | Bagnell et al. | |

(Continued)

FOREIGN PATENT DOCUMENTS

WO 2016130308 8/2016

OTHER PUBLICATIONS

International Search Report and Written Opinion for Application No. PCT/US16/15161 dated Jul. 11, 2016.

(Continued)

*Primary Examiner* — Kipp C Wallace
(74) *Attorney, Agent, or Firm* — Tumey L.L.P.

(57) ABSTRACT

A release mechanism for a jarring tool is formed by a plurality of segmented release lugs. Each lug includes a plurality of axial spaced projections on an inner surface and a plurality of grooves on an outer surface. The projections have either different widths or are separated by varying distances and releasably engage corresponding grooves in a mandrel located within a housing of the tool. The release lugs are positioned between a trigger sleeve and the mandrel. The release lugs may be supported by an annular ring member.

5 Claims, 6 Drawing Sheets

(56) References Cited

U.S. PATENT DOCUMENTS

| | | | |
|---|---|---|---|
| 2,903,241 | A | 9/1959 | Brown |
| 3,050,131 | A | 8/1962 | Siracusa et al. |
| 3,371,730 | A | 3/1968 | Newman |
| 3,414,061 | A | 12/1968 | Nutter |
| 3,606,926 | A | 9/1971 | Schwegman |
| 3,658,140 | A | 4/1972 | Berryman |
| 3,685,599 | A | 8/1972 | Kisling |
| 3,709,478 | A | 1/1973 | Kisling, III |
| 3,797,591 | A | 3/1974 | Berryman |
| 4,036,312 | A | 7/1977 | DeLuish |
| 4,376,468 | A | 3/1983 | Clark |
| 5,022,473 | A | 6/1991 | Taylor |
| 5,069,282 | A | 12/1991 | Taylor |
| 5,133,404 | A | 7/1992 | Dollison |
| 5,330,018 | A | 7/1994 | Griffith |
| 5,624,001 | A | 4/1997 | Evans |
| 6,290,004 | B1 | 9/2001 | Evans |
| 6,948,560 | B2 | 9/2005 | Marsh |
| 7,510,008 | B2 | 3/2009 | Evans |
| 8,205,690 | B2 | 6/2012 | Evans |
| 8,720,540 | B2 | 5/2014 | Gano |
| 10,408,009 | B2 | 9/2019 | Evans |
| 11,473,385 | B2 | 10/2022 | Evans |
| 2005/0087338 | A1 | 8/2005 | Parker |
| 2005/0183889 | A1 | 8/2005 | Marsh |
| 2006/0169456 | A1 | 8/2006 | Evans |
| 2015/0144358 | A1 | 5/2015 | Mejia et al. |
| 2015/0226031 | A1 | 8/2015 | Hekelaar |
| 2016/0024886 | A1 | 1/2016 | Williamson |
| 2016/0237771 | A1 | 8/2016 | Evans |
| 2018/0252064 | A1 | 9/2018 | Evans |
| 2019/0055804 | A1 | 2/2019 | Evans |

OTHER PUBLICATIONS

USPTO Final Office Action Report for U.S. Appl. No. 14/621,577 dated Jul. 6, 2018.
USPTO Non-Final Office Action Report for U.S. Appl. No. 14/621,577 dated Feb. 22, 2018.
USPTO Non-Final Office Action Report for U.S. Appl. No. 14/621,577 dated May 10, 2017.
USPTO Final Office Action Report for U.S. Appl. No. 14/621,577 dated Aug. 28, 2017.
USPTO Notice of Allowance for U.S. Appl. No. 14/621,577 dated Oct. 1, 2018.
International Preliminary Report for International Patent Application No. PCT/US2016/015161 dated Aug. 15, 2017.
European Patent Office Search Report and Written Opinion for Application No. 16749589.4 dated Feb. 13, 2019.
USPTO Non-Final Office Action Report for U.S. Appl. No. 15/973,247 dated Jul. 11, 2018.
USPTO Final Office Action Report for U.S. Appl. No. 15/973,247 dated Dec. 12, 2018.
USPTO Notice of Allowance for U.S. Appl. No. 15/973,247 dated Apr. 29, 2019.
USPTO Non-Final Office Action Report for U.S. Appl. No. 16/168,610 dated May 24, 2019.
European Search Report for Application No. EP 19172632 dated Oct. 23, 2019.
European Examination Report for Application No. 16749589.4 dated Oct. 28, 2019.
USPTO Notice of Allowance for U.S. Appl. No. 16/168,610 dated Dec. 11, 2019.
Extended European Search Report and Written Opinion for Application No. 19172632.2 dated Oct. 30, 2019.
USPTO Issue Notification for U.S. Appl. No. 16/168,610 dated May 13, 2020.
USPTO Issue Notification for U.S. Appl. No. 15/973,247 dated Aug. 21, 2019.
Extended European Search Report for Application No. 19200264.0 dated Mar. 25, 2020.
USPTO Issue Notification for U.S. Appl. No. 14/621,577 dated Jan. 23, 2019.
USPTO Non-Final Office Action Report for U.S. Appl. No. 16/824,179 dated Sep. 24, 2020.
European Examination Report for Application No. 19172632.2-1002 dated Jan. 1, 2021.
USPTO Non-Final Office Action Report for U.S. Appl. No. 16/534,778 dated Sep. 24, 2020.
USPTO Notice of Allowance for U.S. Appl. No. 16/534,778 dated Apr. 16, 2021.
USPTO Final Office Action Report for Application No. 16/824, 179 dated Mar. 30, 2021.
USPTO Non-Final Office Action Report for U.S. Appl. No. 16/250,836 dated Aug. 27, 2021.
European Examination Report for Application No. 19172632.2-1002 dated Jan. 29, 2021.
USPTO Notice of Allowance for U.S. Appl. No. 16/824,179 dated Sep. 7, 2021.
USPTO Issue Notification for U.S. Appl. No. 17/461,395 dated Sep. 28, 2022.
USPTO Notice of Allowance for U.S. Appl. No. 17/461,395 dated Jun. 15, 2022.
USPTO Issue Notification for U.S. Appl. No. 16/534,778 dated Aug. 11, 2021.
USPTO Issue Notification for U.S. Appl. No. 17/968,756 dated Nov. 1, 2023.
USPTO Notice of Allowance for U.S. Appl. No. 17/968,756 dated Jul. 11, 2023.
USPTO Non-Final Office Action for U.S. Appl. No. 17/968,756 dated Jan. 27, 2023.

* cited by examiner

RELEASE LUGS FOR A JARRING DEVICE

This application is a continuation of U.S. patent application Ser. No. 17/968,756 filed Oct. 18, 2022, which is a continuation of U.S. patent application Ser. No. 17/461,395 filed Aug. 30, 2021, which is a continuation of U.S. patent application Ser. No. 16/534,778 filed Aug. 7, 2019, which is a continuation of U.S. patent application serial No. 15,973,247 filed May 7, 2018, which is a continuation-in-part of U.S. patent application Ser. No. 14/621,577 filed Feb. 13, 2015.

BACKGROUND OF INVENTION

1. Field of the Invention

This invention is directed to a release mechanism for a mandrel of a jarring device commonly referred to as a jar. Jars are used in the well drilling industry to free downhole tools that may become lodged in a well. An upward or downward force can be supplied to a tubular string which includes the affected tool in order to break free the tool from the well bore.

2. Description of Related Art

Typically, a release mechanism in the form of an annular collet is provided which normally prevents axial movement of the mandrel. The mandrel is spring biased to move with significant force in an upward or downward direction. If a sufficient force is placed on the mandrel, the collet will release.

U.S. Pat. No. 5,022,473 discloses a release assembly which comprises a plurality of angular segments 62 and 162 that engage in slots 86 and 88, and 186 and 188 respectively. It has been found that this arrangement can result in the segments 62 and 162 becoming out of alignment which could result in the failure of the release mechanism. As disclosed in the patent, the jar requires two sets of release lugs to withstand the anticipated tensile load. In this design the two lug assemblies must be spaced further apart than the total travel of the jar to prevent the lower lug from inadvertently engaging the groove of the upper lug assembly. If a third lug assembly were necessary it would have to be spaced a distance greater than the jar stroke from the lower set. This would significantly increase the total length of the jar and also the cost.

BRIEF SUMMARY OF THE INVENTION

The present invention solves the above noted problem by providing a plurality of angular lug segments each of which has two or more projections that engage corresponding grooves in the mandrel.

In order to avoid misalignment or a jarring situation, the projections having either a differing width or are spaced at different distances. The grooves on the mandrel have a complimentary configuration as will be explained below.

BRIEF DESCRIPTION OF THE SEVERAL VIEWS OF THE DRAWING(S)

DETAILED DESCRIPTION OF THE INVENTION

Figure 1:
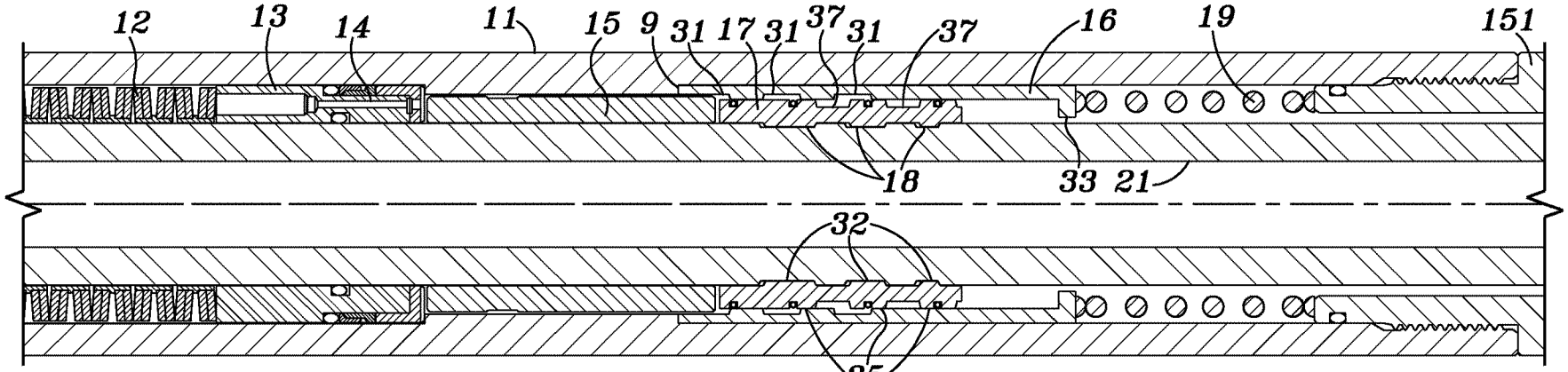
FIG. 1 is a cross-sectional view of a first embodiment of the release lugs as shown in a neutral position.
Figure 2:
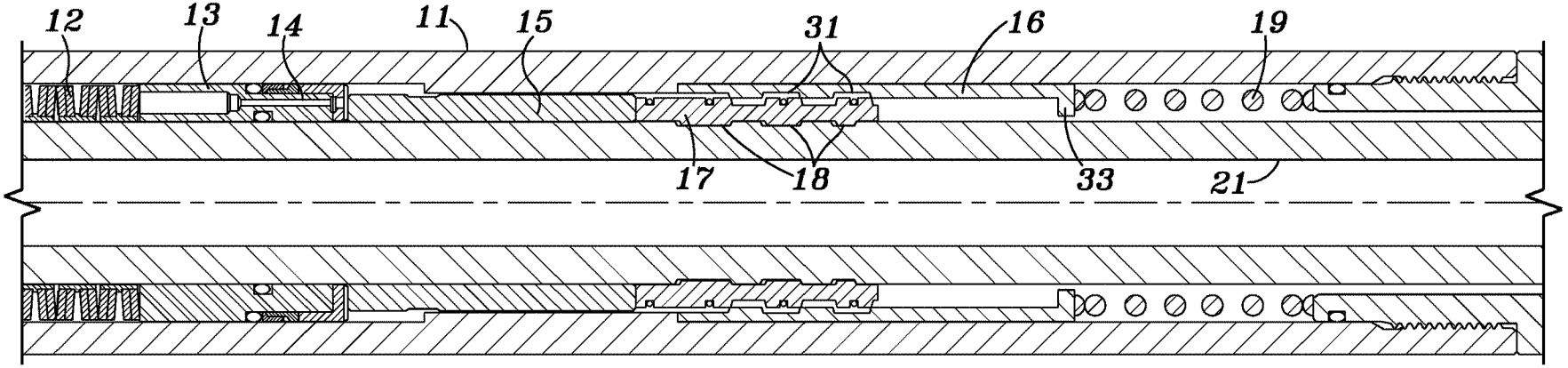
FIG. 2 is a cross-sectional view of the first embodiment of the release lugs just prior to release of the mandrel.
Figure 3:
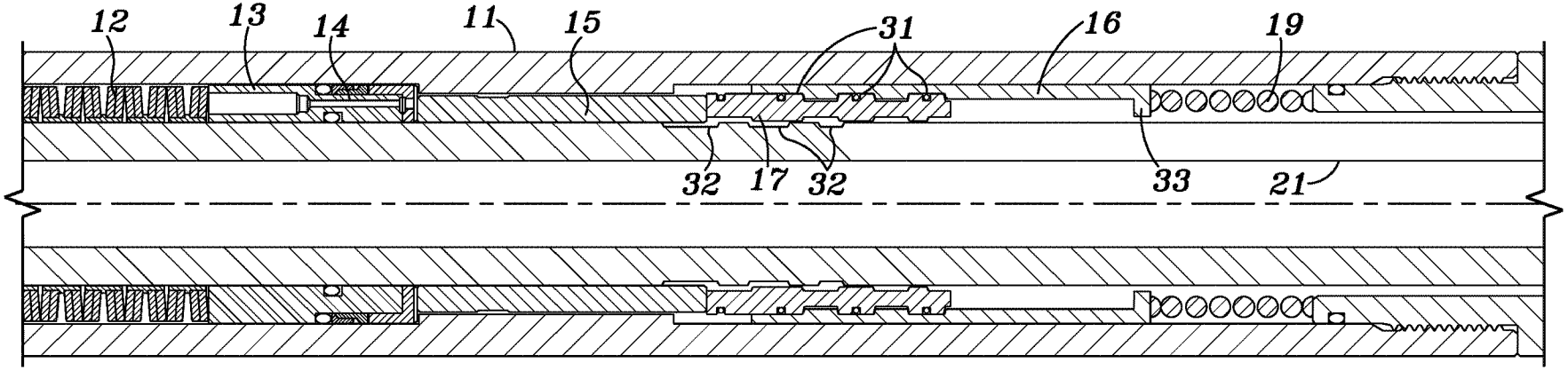
FIG. 3 is a cross-sectional view of the release lugs of FIG. 1 in a release position with the mandrel initially moving.
Figure 9:
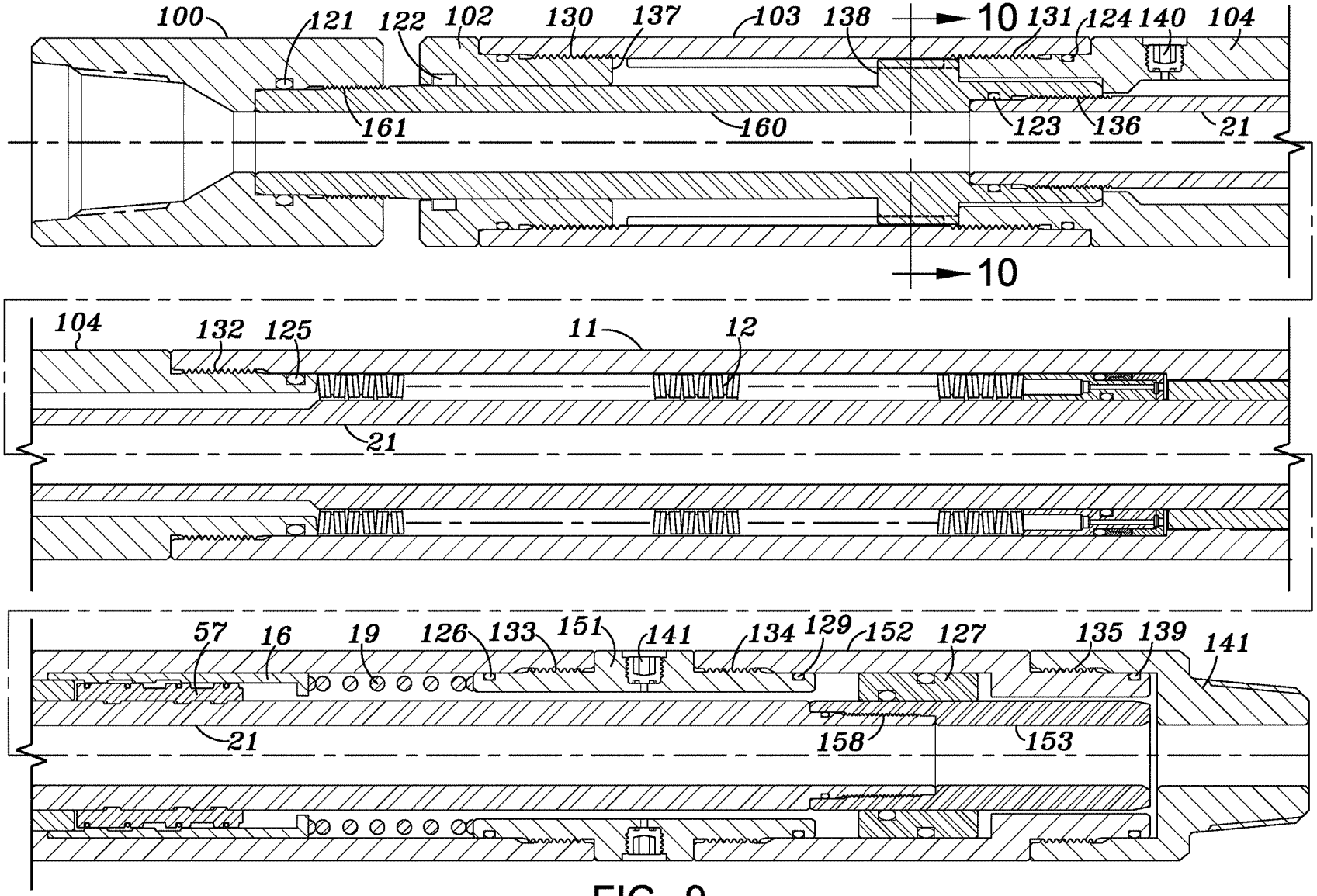
FIG. 9 is a segmented cross-sectional view of an entire jar including the release lugs of FIG. 7.

FIG. 1 illustrates a release mechanism including a plurality of release lugs 17 surrounding mandrel 21 of the jar such as that shown in FIG. 9.

The jar includes a central housing 11, a Belleville spring stack 12, a restrictor orifice 14 and one or more check valves 13, an annular sleeve 15 surrounding mandrel 21 and an annular trigger sleeve 16 having an inwardly projecting lip 33. Annular trigger sleeve 16 is spring biased against a shoulder 9 provided in housing 11 by a spring 19 at lip 33. A lubricant fitting housing 151 is threadedly coupled to the downhole portion of housing 11.

Figure 4:
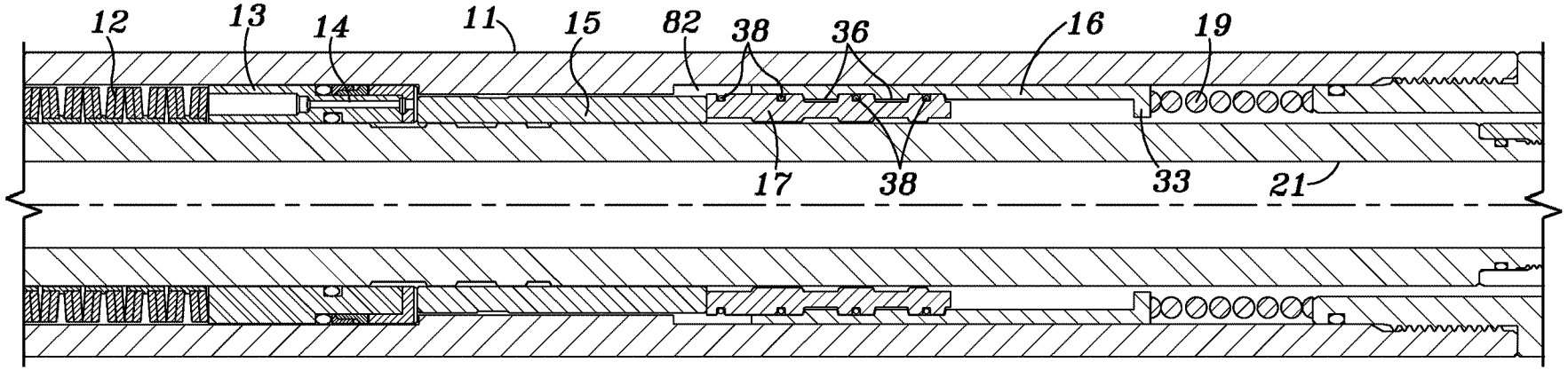
FIG. 4 is a cross-sectional view of the mandrel in a completely released position.
Figure 5:
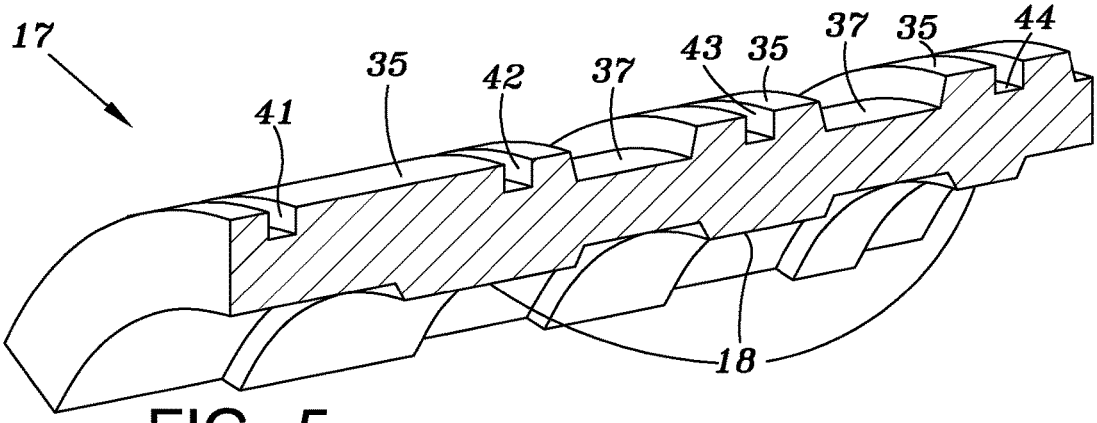
FIG. 5 is a perspective view of a release lug according to a first embodiment of the invention.
Figure 6:
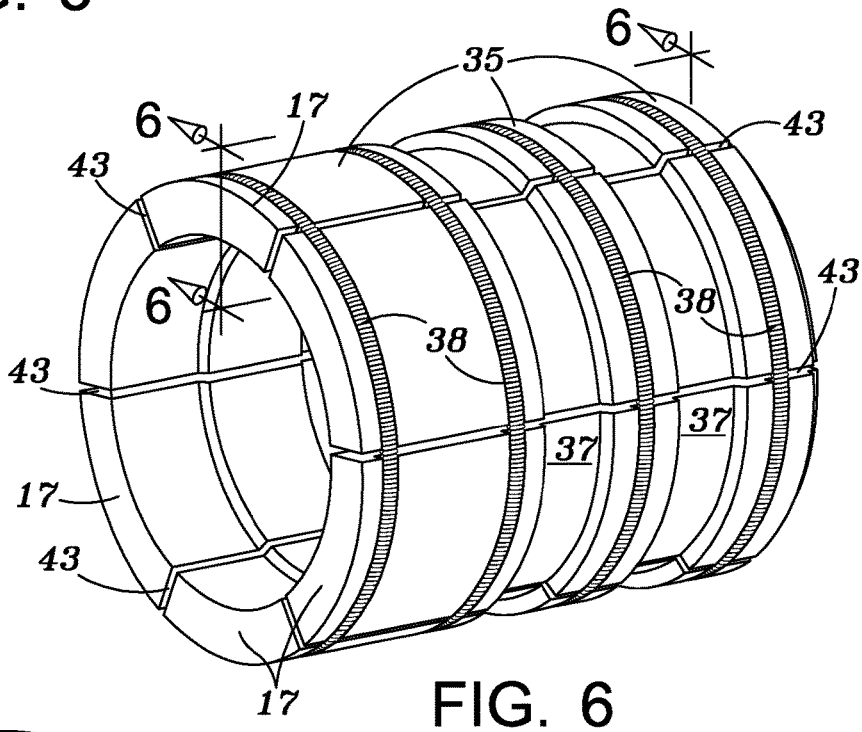
FIG. 6 is a perspective view of a plurality of release lugs forming a release mechanism according to a first embodiment of the invention.

As shown in FIG. 5, each release lug 17 includes a plurality of projections 18 of varying width on its interior surface. Projections 18 in this embodiment are evenly spaced from each other. The exterior surface of the release lug includes a plurality of grooves 37 which are adapted to receive projections 36 of the trigger sleeve 16 as shown in FIG. 4. A plurality of smaller grooves 41, 42, 43 and 44 are also provided on the exterior surface of release lugs 17 and are adapted to hold garter springs 38 as shown in FIG. 6. A plurality of the release lugs are used to form a release mechanism as shown in FIG. 6 having spaces 43 between the release lugs.

Although six release lugs are shown any number of segments for example, 2 thru 12 may be used.

In the rest position shown in FIG. 1, surfaces 35 of the release lugs are in contact with the interior surface of trigger sleeve 16 and projections 18 are located within grooves 32 provided on the outer surface of mandrel 21. As an upward force is applied to mandrel 21 which would be from the left as shown in FIG. 1, mandrel 21 and release lugs 17 will travel to the left, thereby compressing Belleville spring stack 12. As the surfaces 35 align with grooves 31 of the trigger sleeve 16, the beveled surfaces of the projections and grooves of the trigger sleeve, release lugs and mandrel grooves will allow the surfaces to be forced outwardly into grooves 31 resulting in projections 18 disengaging from grooves 32 in the mandrel. The mandrel then is free to move in an upward direction or to the left as shown in FIG. 4. The overall operation of a hydraulic jar is well known and explained in U.S. Pat. Nos. 6,290,004 and 7,510,008, the entire contents of which are expressly incorporate herein by reference thereto.

In order to reload the jar, a downward force is placed on the mandrel which will move the mandrel downward. The garter springs 38 will cause the release lugs to return to their original position with the projections 18 in grooves 32.

Figure 7:
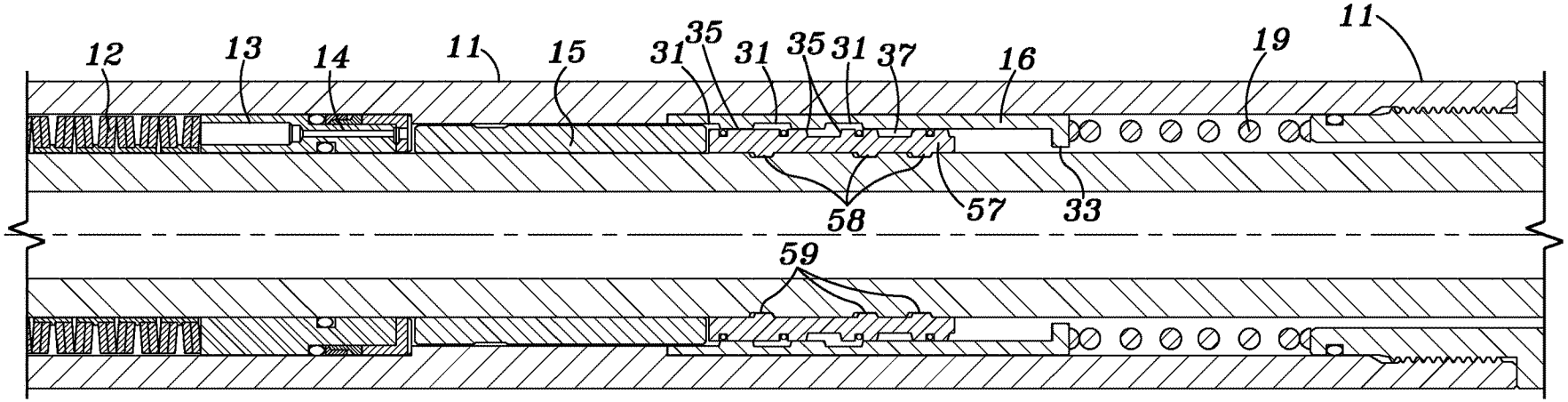
FIG. 7 is a cross-sectional view of a second embodiment of the release lugs shown in a neutral position.
Figure 8:
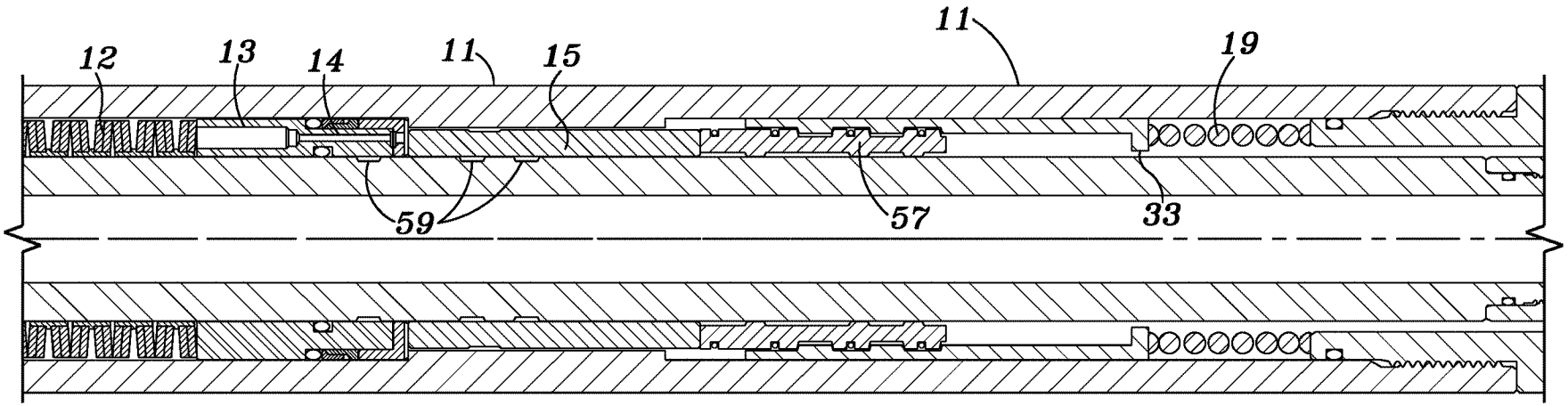
FIG. 8 is a cross-sectional view of the release lugs of the second embodiment in a fully released mode.

Spring 19 which is now compressed will move trigger sleeve 16 back to the neutral position shown in FIG. 1. In the embodiment of FIGS. 7 and 8, the release lugs 57 have been changed to include a plurality of projections 58 that are non-uniformly spaced apart from each other rather than having varying widths. The grooves 59 in the mandrel are also spaced apart accordingly to receive projections 59 in the neutral position as shown in FIG. 7. The outer surfaces of the release lugs are formed in the same fashion as the lugs shown in FIG. 5 so that in the released position of FIG. 8, surfaces 35 of the release lug are located within grooves 31 of the trigger sleeve 16.

Figure 10:
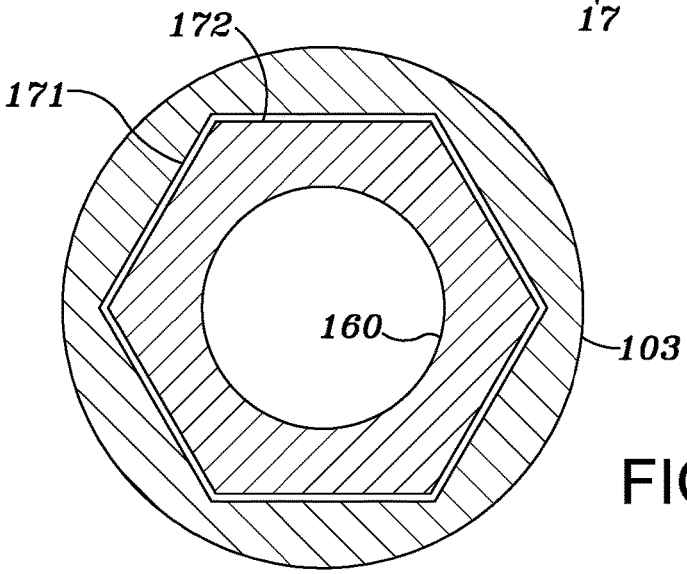
FIG. 10 is a cross-sectional view taken along line 10-10 of FIG. 9.

FIG. 9 illustrates an embodiment of a complete jarring tool that incorporates the release lugs of the embodiment shown in FIGS. 7 and 8. The jar includes a connector 100 for connecting the jar to a tubular string, upper housing members 102 and 103, lubricating fitting 104, central housing 11, a lower lubricating fitting 151, lower housing member 152 and lower connector 141. The jar also includes a Bellville spring stack 12. The housing members are threadably connected to each other at 130, 131, 132, 133, 134 and 135. The mandrel of the jar includes an upper portion 160 which is threadedly connected to connector 100, a central portion 21 and a lower portion 153. The mandrel portions are connected together by threads at 136 and 158. Suitable seals are provided at 121, 122, 123, 124, 125, 126, 129 and 139. A floating piston 127 surrounds the lower portion of mandrel 153. A lubricating material is introduced into the housing through fittings 140 and 141. The upper portion of the mandrel 160 includes an annular raised portion 138 which acts as a hammer against an anvil shoulder 137 on housing upper end member 102. As shown in FIG. 10, upper housing member 103 may comprise a hexagon surface 171 which received a hexagon outer surface 172 on the mandrel portion 160.

The jarring tool of FIG. 9 may incorporate the release lugs shown in the embodiments of FIG. 5 or that of the embodiment of FIGS. 7 and 8.

Figure 11:
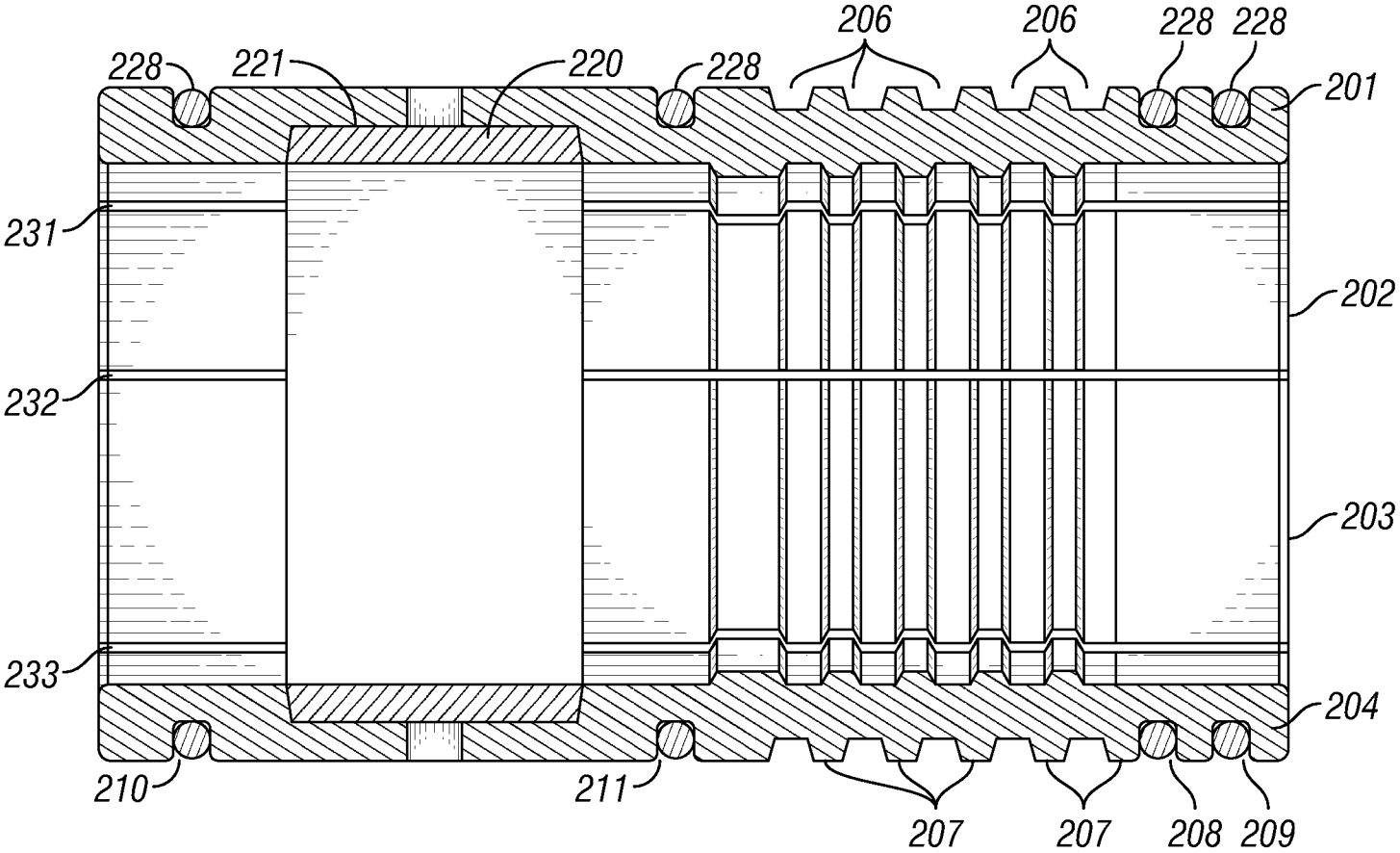
FIG. 11 is a cross sectional view of a third embodiment of a release mechanism according to the invention.

FIG. 11 illustrates a third embodiment of the release mechanism. It also includes a plurality of individual release lugs 201-204 and those not shown that are spaced apart by a distance 231, 232, 233 along their entire length.

Each release lug includes a plurality of grooves 206 and a plurality of ridges 207 that cooperate with a trigger sleeve and mandrel in the same manner as previous embodiments. An inner annular ring 220 is positioned within an interior groove 221 provided as in each release lug. Ring 220 acts as a stabilizer for the release lugs. An annular garter spring 228 may be positioned in each of the grooves 210, 211, 208, 209 provided in each release lug in the manner shown in FIG. 6.

Although the present invention has been described with respect to specific details, it is not intended that such details should be regarded as limitations on the scope of the invention, except to the extent that they are included in the accompanying claims.

The invention claimed is:

1. A release mechanism for a jarring tool comprising:

a plurality of arcuate release lugs, each release lug including an inner surface and an outer surface;

a plurality of axially spaced projections on the inner surface of the release lugs and a plurality of grooves on the outer surface of the release lugs, each release lug including an interior groove axially spaced from the projections on the inner surface of the release lugs and, an annular ring member positioned within the interior groove of the release lugs such that the ring member substantially fills the interior groove and sides of the ring member fully engage sides of the interior groove of the release lugs in a rest position;

a mandrel having a longitudinalaxis and a plurality of axially spaced grooves on an outer surface of the mandrel; the annular ring member and release lugs being longitudinally moveable along the longitudinalaxis of the mandrelwhen the mandrelis released from the release lugs, and an annular trigger sleeve longitudinally moveable with respect to the release lugs surrounding the mandrel, the release lugs being positioned between the annular trigger sleeve and the mandrel.

2. A release mechanism for a jarring tool as claimed in claim 1 wherein the projections have different axial widths.

3. A release mechanism for a jarring tool as claimed in claim 1 wherein the grooves in the mandrel have a width corresponding to the width of the projections on the inner surface of the release lugs.

4. A release mechanism for a jarring tool as claimed in claim 1 including three projections that are axially spaced from each other by a different distance.

5. A release mechanism for a jarring tool as claimed in claim 4 including at least three grooves in the outer surface of the mandrel, the grooves being axially spaced from each other by a different distance.

* * * * *